US006572441B2

(12) United States Patent
Lukner et al.

(10) Patent No.: US 6,572,441 B2
(45) Date of Patent: Jun. 3, 2003

(54) METHOD OF AND APPARATUS FOR CHEMICAL-MECHANICAL POLISHING

(75) Inventors: Ralf Lukner, Austin, TX (US); Owen Hehmeyer, Austin, TX (US)

(73) Assignee: Momentum Technical Consulting, Inc., Austin, TX (US)

( * ) Notice: Subject to any disclaimer, the term of this patent is extended or adjusted under 35 U.S.C. 154(b) by 86 days.

(21) Appl. No.: 09/871,236

(22) Filed: May 31, 2001

(65) Prior Publication Data

US 2002/0182978 A1 Dec. 5, 2002

(51) Int. Cl.[7] ..... B24B 1/00

(52) U.S. Cl. ..... 451/5; 451/8; 451/41; 451/285; 451/189; 324/671

(58) Field of Search ..... 451/5, 6, 41, 8, 451/285–289, 398; 156/345.13; 324/621

(56) References Cited

U.S. PATENT DOCUMENTS 5,222,329 A * 6/1993 Yu ..... 451/11
5,337,015 A * 8/1994 Lustig et al. ..... 324/671
5,876,265 A * 3/1999 Kojima ..... 451/10
5,904,609 A * 5/1999 Fukuroda et al. ..... 451/8
6,106,662 A * 8/2000 Bibby et al. ..... 156/345.13
6,159,073 A * 12/2000 Wiswesser et al. ..... 451/6
6,179,688 B1 * 1/2001 Beckage et al. ..... 451/6
6,254,453 B1 * 7/2001 Li et al. ..... 451/8
6,257,953 B1 * 7/2001 Gitis et al. ..... 451/5
6,293,845 B1 * 9/2001 Clark-Phelps ..... 451/5
6,338,667 B2 * 1/2002 Sandhu et al. ..... 451/5
6,352,466 B1 * 3/2002 Moore ..... 451/5

* cited by examiner

*Primary Examiner*—George Nguyen
(74) *Attorney, Agent, or Firm*—Jackson Walker LLP; Robert C. Klinger

(57) ABSTRACT

During a CMP operation, vibration-caused variations in the forces holding a wafer against a polishing pad, and/or relatively moving the pad and the wafer are measured and the standard deviation thereof is used to minimize or eliminate the deleterious effects of the vibrations.

33 Claims, 1 Drawing Sheet

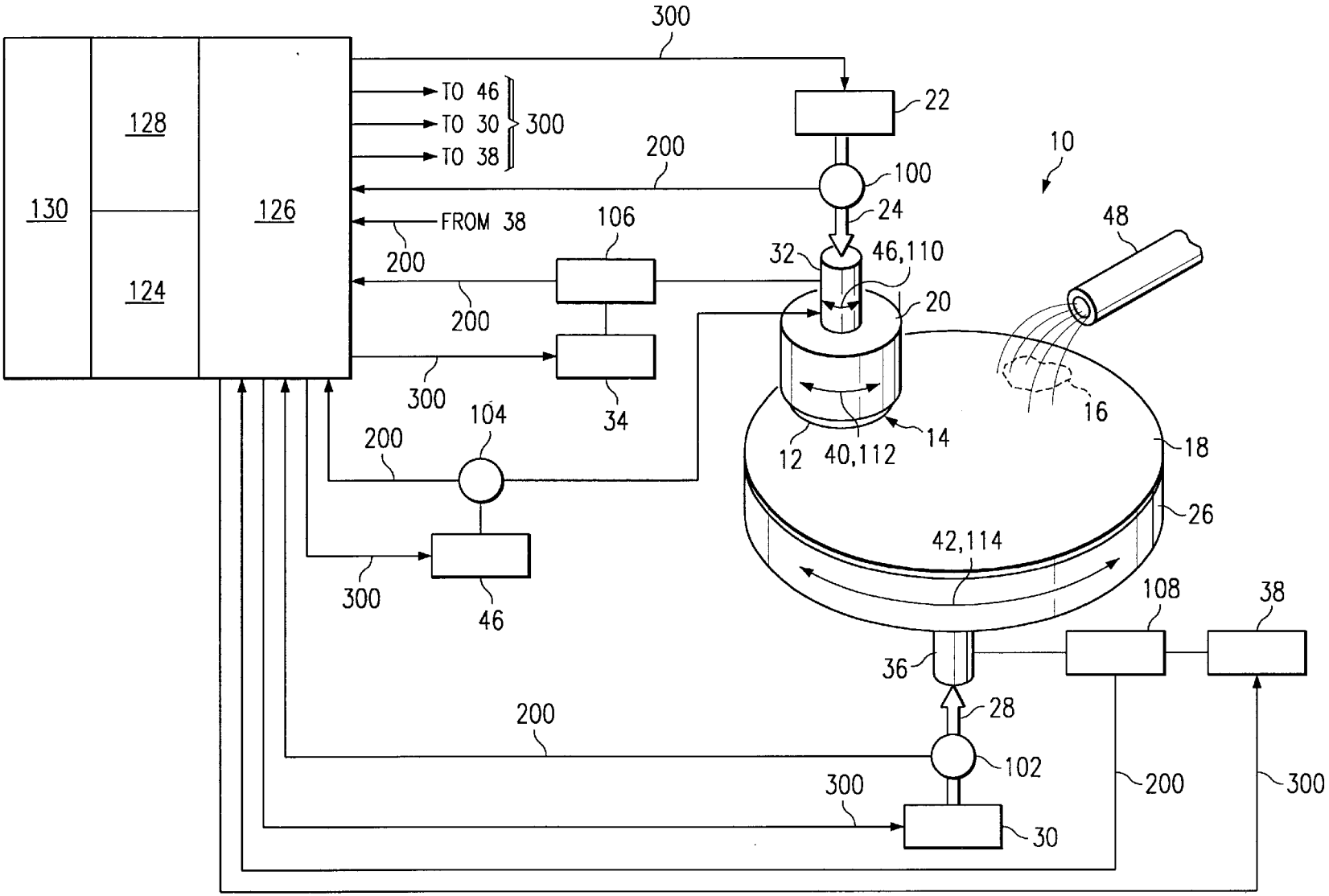
10
48
16
18
26
38
300
108
200
22
100
24
46,110
20
14
42,114
28
102
30
36
32
40,112
12
300
200
106
34
300
TO 46
TO 30
TO 38
FROM 38
200
300
104
46
200
300
200
126
128
124
130

METHOD OF AND APPARATUS FOR CHEMICAL-MECHANICAL POLISHING

FIELD OF THE INVENTION

The present invention relates to a method of and apparatus for carrying out chemical-mechanical polishing ("CMP"), and, more specifically, to CMP operations performed on semiconductor wafers.

BACKGROUND OF THE INVENTION

Certain stages of semiconductor device manufacture involve the deposition or other formation on a semiconductor substrate of numbers of alternating layers of various materials, such as conducting, insulating and semiconducting materials. These materials may include insulators, metallic oxides, metals, and glass After being formed on the substrate, the layers are lithographically patterned and may be modified by various chemical and physical processes, for example by chemical or electrical etching following appropriate masking, doping or by ion implantation, to produce on the substrates—now termed wafers—numerous electrical devices and electrical interconnections therebetween.

The wafers are extremely delicate and must be protected against the application of external forces which are sufficiently high to damage the devices and interconnections. Damage to only a few of the devices on a wafer may render the entire wafer unsuitable for intended use.

After various devices and interconnections have been defined on a wafer, it is often necessary to remove part or all of one or more of those remaining portions of the previously deposited layers, leaving the resulting surface defect-free and flat. Such layer removal resulting in a flat, defect-free surface is often termed "planarization." The deposition of additional layers—and their subsequent planarization—may follow, as may additional litographic steps. One commonly used planarizing technique is chemical-mechanical polishing.

In a CMP operation, the surface of the wafer from which material is to be removed is held against a polishing pad mounted on a rotatable carrier. Usually, the wafer is held upside-down by wafer carrier via application of a negative pressure to the wafer through the wafer carrier. Either or both of the carriers may be rotated in either direction. A slurry is introduced between the pad and the wafer and is held on the pad. The slurry typically includes an appropriate abrasive suspended in an appropriate chemical etchant. The combined action of the etchant and mechanical abrasion as the wafer and the pad relatively rotate removes a selected amount of material from the wafer. Various methods and apparatus are available to ensure that polishing continues only for as long as necessary and that material that should remain is not removed. See for example U.S. Pat. No. 6,179,688, entitled "METHOD AND APPARATUS FOR DETECTING THE ENDPOINT OF A CHEMICAL-MECHANICAL POLISHING OPERATION," one of the co-inventors of which is a co-inventor of the present invention. See also commonly assigned U.S. patent application Ser. No. 09/679,836, filed Oct. 5, 2000 in the name of Fu Zhang, and entitled "CHEMICAL/MECHANICAL POLISHING ENDPOINT DETECTION DEVICE AND METHOD." Both of the foregoing documents are incorporated by reference hereinto.

It has been observed that during CMP vibrations often occur in the moving carrier-wafer-slurry-pad-carrier system and in associated elements of CMP polishing apparatus. Of course, vibration is common in equipment having rotating parts. However, given the non-robust nature of the wafers, damage thereto may well follow such vibration. Vibrations in the CMP apparatus may also damage various tool sensors, such as those described in the foregoing '688 patent, and may even cause a wafer to separate from its carrier, resulting in catastrophic destruction of the wafer when it strikes another object.

It has also been observed that the above-described vibrations are difficult, if not impossible, to predict before initiating a CMP process; a non-vibrating CMP process may suddenly experience extreme vibrations for seemingly unknown reasons. Vibrations occurring during CMP may be mild or quite severe in intensity, but they are not usually monitored in present day CMP operations. It is known to attach accelerometers to the frame of machinery performing CMP, but this expedient is usually a response to past severe vibrations that have already damaged one or more wafers.

Accordingly, there exists a need for methods and apparatus for detecting vibrations during CMP operations and for analyzing these vibrations to eliminate them from both an on-going CMP operation and from future CMP operations. The present invention is intended to fill this need.

SUMMARY OF THE INVENTION

With the above and other desiderata in mind, the present invention comprises a method of and apparatus for performing CMP of a surface of a semiconductor wafer. Typically, in performing CMP, a wafer on a rotatable carrier is held against a polishing media-carrier, which may be a pad held on a rotatable carrier. Normal force is applied to the wafer and/or the pad to maintain the wafer surface in engagement with the pad. Rotative forces may be applied to the wafer carrier and/or the pad carrier to effect relative rotation between the engaged wafer surface and pad.

Vibrations may occur during the performance of CMP. These vibrations may be deleterious to the CMP equipment and, more to the point, to the wafer. The vibrations are manifested as variations in the normal and rotational forces.

To minimize or eliminate the vibrations after the initiation of a CMP operation, one or more of the applied forces—that is, the normal force effecting engagement between the wafer surface and the pad and/or the rotational forces applied to the wafer carrier and/or the pad carrier—are continuously measured per unit time. The standard deviation of each measured force is calculated by using the measured values of force(s) and CMP is adjusted in response to the magnitude of the standard deviation to minimize the standard deviation.

Two species of the foregoing are contemplated. In one, a CMP operation is carried out and the standard deviation of all of the measured forces is calculated. This standard deviation is analyzed to determine the likelihood that the wafer just planarized may be damaged and to adjust the CMP for the next and subsequent polishings. This process may be iterated for subsequent polishing operations.

The other species involves adjusting an on-going CMP operation in real time in response to the standard force deviation calculations.

In both species, the measured force(s) may be the normal force, one or more of the rotational forces, or both the normal force and one or more of the rotational forces.

One embodiment of the second species cumulates force measurements and recalculates a new standard deviation following each measurement. Preferably, standard deviation calculation based on these measurements is not begun until CMP proceeds for a time sufficient to cumulate enough force measurements to calculate a meaningful standard deviation. The cumulation may persist for a time period called a "fixed time window." After a first standard deviation is calculated, subsequent standard deviations are calculated for measurements taken during the fixed time window, that is, for the same number of measurements. Thus, it is preferred that subsequently used fixed time windows are all the same length. The fixed time windows may either not overlap or may overlap a selected amount.

The time window may also be a "dynamic time window," that is an ever expanding time window the use of which results in each standard deviation calculation, following each new force measurement, encompassing all of the previous force measurements.

Other embodiments contemplate terminating the CMP operation if a measured force exhibits a predetermined characteristic. Here, a running average of the measurements of one or more of the forces is calculated per unit time. The extant running average is subtracted from each measured force value and the CMP operation is terminated if any resulting difference exceeds a predetermined limit.

BRIEF DESCRIPTION OF THE DRAWING

FIG. 1 is a generalized, schematic depiction of CMP apparatus according to the present invention for effecting the method of the present invention.

DETAILED DESCRIPTION

Referring first to FIG. 1, there is shown a schematic or generalized view of CMP apparatus 10 according to the present invention for effecting the method of the present invention.

A CMP operation, as described above and in the '688 patent and the '836 application involves the removal of a layer 12 of a semiconductor wafer 14 through the abrasive and chemical action of a chemically active slurry 16 and a polishing pad 18. The wafer 14 is typically mounted upside down on a rotatable carrier 20, for example by applying a negative pressure through the carrier 20 to the bottom of the wafer 14. Facilities, generally denoted at 22, push the carrier 20 and the wafer 14 downward to maintain the surface of the layer 12 to be removed or planarized against the pad 18. This downward push is represented by the arrow 24. In the latter event the pad 18, which is mounted as convenient to a rotatable platen or polishing table 26, is held in its vertical position by the platen 26. Alternatively an upward force 28 may be applied to the platen 26 and the pad 18 mounted thereon by facilities, generally designated at 30. If desired, both forces 24,28 may be applied simultaneously.

A motor, schematically shown at 32, selectively rotates the carrier 20 when energized by a power source 34. A motor, schematically shown at 36, selectively rotates the platen 26 when energized by a power source 38. As shown by the arrows 40 and 42, the carrier 20 and the platen 26 may be rotated in either direction, as desired. Facilities, generally shown at 44, may also selectively reciprocate the carrier relative to the pad 18, as shown by the arrow 46.

The chemically active slurry 16 is selectively deposited on the pad 18 by facilities (not shown) which include a slurry dispensing tube or nozzle 48 as the desired relative motion between the pad 18 and the layer 12 is effected. One or both of the forces 24 and 28 are applied and the surface of the layer 12 is polished and planarized by the chemical action of the slurry 16 and by the abrasive action thereof due to the relative pad-layer 12–18 movement as these two elements are maintained in engagement.

Rotating machinery is often subject to unpredictable vibration, and the apparatus 10 is no exception. As explained above, such vibrations can have deleterious effects on the wafer 14 and on the apparatus 10. Specifically, vibrations can break the wafer 14, especially when the vibrational forces are sufficiently large to eject the wafer 14 away from the carrier 20, and can damage sensitive elements associated with the apparatus.

It has been found that vibrations can also have a deleterious effect on the quality of polishing or planarization of the surface of the layer 12 by there being either too much or too little of the layer 12 removed or by the surface of the layer 12 not being planar when the operation is completed.

The present invention is utilized to analyze and eliminate or ameliorate these vibrations. Specifically, sensors 100, 102, 104, 106 and 108 are employed to respectively measure, during the effectuation of a polishing operation, the down force 24, the up force 28, a reciprocating force 110 responsible for reciprocation 46, a rotative force 112 which effects the rotation 40 of the carrier 20, and a rotative force 114 which effects the rotation 42 of the platen 26. The sensors may be any well known sensors electrical, mechanical or electro-mechanical. For example, where the motors 32 and 36 (or any of the actuating facilities 22, 30 or 46) are electric motors, steppers, solenoids or other electric actuators, the sensors 106 and 108 (and the sensors 100, 102 and 104) may measure the current therethrough. This current will represent the amount of force needed to effect the intended operation thereof and, importantly, will represent variations in the current brought about by vibrations occurring during the polishing operation.

It has been found that the standard deviation of the down force 24 during a polishing operation is a primary indicator directly related to the magnitude of vibrations and to the likelihood that wafers 14 will be damaged of that planarization thereof will not be effected in a desirable manner. Secondary indicators are the standard deviations of the rotative and reciprocating forces 112,114 and 110 during polishing. Accordingly, as polishing proceeds, the output of the sensor 100—and/or, alternately, of any other sensors 102–108 that are also present—is fed to facilities 120 which performs a variety of functions, as described below. The application of these signals to the facilities is schematically represented by the lines 200 running from the sensors 102–108 to the facilities 120.

The facilities 120 include clock or timing facilities 124 and facilities 126 that calculate standard deviation per unit time for a number of values fed thereto. Such values and the number thereof may vary according to the present invention. The function of the clock 124 is to predetermine the unit time during which force measurements are made. A unit time, or sample rate, of 150 milliseconds has been found adequate.

First, the values may comprise only down force 24 measurements made by the sensor 100 during each unit of time set by the clock 124 during a complete polishing operation of a wafer 14. Since the standard deviation of the down force 24 is a measure of the quality of vibrations occurring during polishing, the standard deviation calculated by the facilities 124 may be used to evaluate, or as a measure of, the quality of the planarization achieved by the polished wafer 14. Moreover this standard deviation may be used to adjust the apparatus 10 which effected polishing so that subsequent polishing operations will produce acceptable planarizations.

Second, the values may include all of the measurements of force 28,110,1121 and 114 made by some or all of the other sensors 102–108, either alone or in combination with each other and/or the down force 24 measurements. The resulting standard deviations may be used to the same ends as the down force 24 standard deviations.

Third, the measurements of the down force 24 and/or other forces 28,110,112,114 may be used to adjust an on-going polishing operation in real time. In this event, standard deviation calculations may be used to either adjust the apparatus 10 to eliminate or minimize vibrations, or directly counteract the force variations caused by the vibrations by affecting the facilities 22,30,34,38, and 46 to apply forces opposed to those produced by the vibrations. In this event, several embodiments are contemplated:

(1) The start of standard deviation calculations may be delayed by delay facilities 128 as the sensor 100 measures down forces per unit time and sends these to storage in the facilities 126. After a selected delay, during which sufficient down force values are stored to yield a meaningful standard deviation, the facilities 128 instruct the facilities 126 to calculate a standard deviation;

(2) The delay selected in (1) may be used as a "time window" for subsequently making further force measurements. The time window may be used in two ways:

(a) The time window may be followed by another time window which begins where the first ends, that is, without overlap between the time windows so that none of the force measurements taken during one window is used in a later measurement during a subsequent window, or (b) The time windows may be overlapped so that adjacent windows have some measurements in common.

Lines numbered 300 schematically represent the control of the polishing process by the facilities 120

The above-described operation of the apparatus 10 of the present invention to effect the method of the present invention is achieved by using well known devices—the standard deviation calculator 126, the clock 124, and the delay 128—all as generally described, which are either constructed or hard-wired to perform as described, or a software-programmable device. Devices such as processors, DSP's, PC's and similar items may be used.

The facilities 120 may also set a maximum vibration point upon the occurrence of which, the operation of the apparatus is stopped. The maximum vibration point may be an absolute force measurement which exceeds a selected value, as determined by one of the sensors and the facilities 120, including a selected maximum value facility 130, or a standard deviation which exceeds a selected standard deviation maximum. Also, a running average of the measured values of a force of interest may be subtracted from each measured value of the force with the difference being used to terminate polishing if it exceeds a selected maximum as set by the facilities 130. A stop signal produced by the foregoing may be transmitted to the various motive power sources of the apparatus 10 or to a master on-off switch (not shown).

What is claimed is:

1. A method of performing chemical-mechanical polishing (CMP) of a surface of a planar semiconductor wafer, wherein (a) normal force is applied to the wafer and a planar polishing media-carrier parallel thereto to maintain the surface of the wafer in engagement with the carrier, (b) force is applied to the wafer, to the carrier or to both thereof to effect relative movement between the engaged wafer surface and the carrier, and (c) vibrations, indicative of potentially deleterious variations in the forces, tend to occur during the CMP operation, the method comprising:

effecting a CMP operation;

measuring one or more of the applied forces per unit time;

calculating the standard deviation of each measured force by using values derived from each successive force measurement; and adjusting CMP in response to the standard deviation in order to minimize the standard deviation.

2. A method as in claim 1, wherein:

CMP adjustment occurs in a selected CMP operation following a previous CMP operation.

3. A method as in claim 2, wherein:

the adjustment of a CMP operation is effected in response to one or more previously calculated standard deviations.

4. A method as in claim 1, wherein:

the measured applied force is the normal force.

5. A method as in claim 1, wherein:

the measured applied force is one or both rotational forces.

6. A method as in claim 1, wherein:

the measured applied force is the normal force and one or both rotational forces.

7. A method as in claim 1, wherein:

CMP adjustment occurs in real time while the CMP operation is on-going.

8. A method as in claim 7, wherein:

a standard deviation of each measured force is calculated following each measurement thereof.

9. A method as in claim 8, wherein:

force measurement begins at the beginning of the CMP operation, but calculating the standard deviation begins only after, and is based on, a selected number of serial force measurements, such selected number representing a time window.

10. A method as in claim 9, wherein:

a series of standard deviations are calculated each being based on measurements made during subsequent time windows.

11. A method as in claim 10, wherein:

the time windows are all the same length.

12. A method as in claim 10, wherein:

the time windows overlap previous time windows and are overlapped by subsequent time windows.

13. A method as in claim 10, wherein:

the time windows do not overlap.

14. A method as in claim 8, wherein:

the standard deviation calculation for each force includes all previous measured values of such force.

15. A method as in claim 7, which further comprises:

terminating the CMP operation if one of the measured forces exhibits a predetermined characteristic.

16. A method as in claim 15, wherein the terminating step comprises:

calculating a running average of one or more of the measured forces per unit time, subtracting the running average of a measured force from each measured value thereof, and terminating the CMP operation if any difference resulting from the previous step exceeds a predetermined limit.

17. An apparatus for performing chemical-mechanical polishing (CMP) of a surface of a planar semiconductor wafer, wherein (a) first facilities apply normal force to the wafer and a planar polishing media-carrier parallel thereto to maintain the surface of the wafer in engagement with the carrier, (b) second facilities apply force to the wafer, to the carrier or to both thereof to effect relative rotation between the engaged wafer surface and the carrier, and (c) vibrations, indicative of potentially deleterious variations in the normal and rotational forces, tend to occur during a CMP operation, the apparatus comprising:

a means for measuring one or more of the applied forces per unit time;

a means for calculating the standard deviation of each measured force by using values derived from each successive force measurement; and a means for adjusting CMP in response to the standard deviation in order to minimize the standard deviation.

18. Apparatus as in claim 17, wherein:

CMP adjustment occurs in a selected CMP operation following a previous CMP operation.

19. Apparatus as in claim 18, wherein:

the adjustment of a CMP operation is effected in response to one or more previously calculated standard deviations.

20. Apparatus as in claim 17, wherein:

the measured applied force is the normal force.

21. Apparatus as in claim 17, wherein:

the measured applied force is one or both rotational forces.

22. Apparatus as in claim 17, wherein:

both the normal force and one or both rotational forces are measured.

23. Apparatus as in claim 17, wherein:

CMP adjustment occurs in real time while the CMP operation is on-going.

24. Apparatus method as in claim 23, wherein:

a standard deviation of each measured force is calculated following each measurement thereof.

25. Apparatus as in claim 24, wherein:

force measurement begins at the beginning of the CMP operation, but calculating the standard deviation begins only after, and is based on, a selected number of serial force measurements, such selected number representing a time window.

26. Apparatus as in claim 25, wherein:

a series of standard deviations are calculated each being based on measurements made during subsequent time windows.

27. Apparatus as in claim 26, wherein:

the time windows are all the same length.

28. Apparatus as in claim 26, wherein:

the time windows overlap previous time windows and are overlapped by subsequent time windows.

29. Apparatus as in claim 26, wherein:

the time windows do not overlap.

30. Apparatus as in claim 24 wherein:

the standard deviation calculation for each force includes all previous measured values of such force.

31. Apparatus as in claim 23 which further includes:

means for terminating the CMP operation if one of the measured forces exhibits a predetermined characteristic.

32. Apparatus as in claim 31, wherein the terminating means comprises:

means for calculating a running average of one or more of the measured forces per unit time, means for subtracting the running average of a measured force from each measured value thereof, and means for terminating the CMP operation if any difference resulting from the previous step exceeds a predetermined limit.

33. An apparatus for performing chemical-mechanical polishing (CMP) of a surface of a planar semiconductor wafer, the apparatus comprising:

a plurality of actuators adapted to apply a variable force to the wafer and to a planar polishing pad to maintain the surface of the wafer in engagement with the pad;

a plurality of rotators adapted to apply a variable force effecting relative motion between the engaged wafer surface and the pad;

a plurality of sensors coupled to said actuators and rotators and adapted to measure the applied forces for effecting, per unit time, a predetermined number of measurements of one or more of the applied forces during the CMP operation;

a calculator having an input for receiving an signal from said sensors indicative of said measurements and adapted to determine the standard deviation of each force measurement; and adjusting facilities for variably effectuating the applied forces of at least one of said actuators and rotators responsive to the standard deviation in order to minimize the standard deviation to thereby minimize vibration indicative of potentially deleterious variations in the forces tending to occur during the CMP operation.

* * * * *